US007028854B1

(12) United States Patent
Londrico

(10) Patent No.: US 7,028,854 B1
(45) Date of Patent: Apr. 18, 2006

(54) ORGANIZER INCLUDING RESILIENT RETAINING MEMBERS

(75) Inventor: Philip Londrico, North Royalton, OH (US)

(73) Assignee: Master Mfg. Co., Inc., Cleveland, OH (US)

( * ) Notice: Subject to any disclaimer, the term of this patent is extended or adjusted under 35 U.S.C. 154(b) by 26 days.

(21) Appl. No.: 10/692,776

(22) Filed: Oct. 24, 2003

(51) Int. Cl.
*A47F 5/08* (2006.01)
*A47F 7/00* (2006.01)

(52) U.S. Cl. ..... 211/89.01; 211/69.8; 211/70.6; 211/94.01; 211/120

(58) Field of Classification Search ..... 211/94.01, 211/70.6, 89.01, 60.1, 69.8, 120, 15, 69.1
See application file for complete search history.

(56) References Cited

U.S. PATENT DOCUMENTS

| | | | | |
|---|---|---|---|---|
| 231,969 | A * | 9/1880 | Perkins | 211/69.8 |
| 1,214,606 | A * | 2/1917 | Steig | 211/120 |
| 1,388,154 | A * | 8/1921 | Coutts | 211/44 |
| 1,822,734 | A * | 9/1931 | Harrington | 211/120 |
| 2,430,624 | A | 11/1947 | Vollmer | |
| 2,975,949 | A | 3/1961 | Lutsky | |
| 3,388,809 | A | 6/1968 | Irish | |
| 3,812,976 | A * | 5/1974 | Rempel | 211/70.6 |
| 4,757,906 | A | 7/1988 | Ovitz, III | |
| 4,936,469 | A | 6/1990 | Drower | |
| 5,398,823 | A | 3/1995 | Anders | |
| 5,419,443 | A | 5/1995 | Niederberger et al. | |
| 5,516,581 | A | 5/1996 | Kreckel et al. | |
| 5,570,794 | A | 11/1996 | Drower | |
| 5,718,342 | A | 2/1998 | Drower et al. | |
| 5,727,697 | A | 3/1998 | Ricciardelli et al. | |
| 5,775,520 | A | 7/1998 | Drower | |
| 5,779,066 | A | 7/1998 | Drower et al. | |
| 5,794,795 | A * | 8/1998 | Stemmons | 211/26 |
| 5,915,573 | A | 6/1999 | Drower et al. | |
| 6,372,335 | B1 | 4/2002 | Luhmann et al. | |
| 6,389,991 | B1 * | 5/2002 | Morrisson | 108/61 |
| 6,571,966 | B1 * | 6/2003 | Hsiao | 211/70.6 |
| 6,848,624 | B1 * | 2/2005 | Dianetti et al. | 236/92 B |

* cited by examiner

*Primary Examiner*—Jennifer E. Novosad
(74) *Attorney, Agent, or Firm*—Renner, Otto, Boisselle & Sklar, LLP

(57) ABSTRACT

An organizer (10) that includes a housing (12) having a first end (12*a*), a second end (12*b*), and a channel (14) extending along at least a portion of the housing (12) between the first end (12*a*) and the second end (12*b*). A plurality of retaining members (18) are coupled to the housing (12) using the channel (14). Each retaining member (18) exerts a retaining force upon one or more adjacent retaining members (18). The organizer (10) retains an item placed between adjacent retaining members (18) using the retaining force. The retaining members (18) include a hookless coupling segment (19) for coupling the retaining members (18) to the housing. The housing (12) includes at least one divider (27, 30) along at least a portion of the channel (14) to separate the channel (14) into at least two areas (14*a*, 14*b* and 14*c*).

36 Claims, 4 Drawing Sheets

ORGANIZER INCLUDING RESILIENT RETAINING MEMBERS

FIELD OF THE INVENTION

The present invention generally relates to organizers, and, more particularly, to an organizer including resilient retaining members.

BACKGROUND OF THE INVENTION

People use various tools, objects, or other items to perform activities in an environment. Unorganized distribution of these items in an environment may decrease the safety and efficiency of the persons or activities associated with that environment. Additionally, there may be limited space in an environment to store such items.

Persons performing these activities and inhabiting these environments may desire to organize and secure items in order to increase safety, efficiency and more effectively use the available space according to their needs. A known organization technique allows persons to place loose items in a clip affixed to an upright surface. However, such systems may have difficulty accommodating a large number of items. Further, users may not be able to remove easily items from such systems once secured.

Another known organization technique uses a number of flexible plastic loops that, when connected to a frame, may exert lateral forces upon one another and upon items inserted between the loops in order to secure such items. However, reconfiguration of these systems by removing or adding loops may not be easily accomplished as the loops are designed to be fixedly retained by the frame by a hooked tab. In other cases, the tab used to couple the loop to the frame may not be sufficient to retain the loop in the frame when a force that is generally normal to the elongated extent of the frame is applied to the loop. In still other devices, stops on the sides of the frame take up a significant portion of the frame that could be used to retain additional items.

SUMMARY OF THE INVENTION

There is a need for an organizer that uses resilient retaining members and is easily reconfigurable, e.g., the number of retaining members coupled to the housing of the organizer can be easily increased or decreased. Further, there is a need for an easily reconfigurable organizer with retaining members having coupling segments that tend to inhibit inadvertent removal of a retaining member when a force that is generally normal to the elongated extent of the housing is applied to the retaining member.

An aspect of the invention relates to an organizer that includes a housing having a first end, a second end, and a channel extending along at least a portion of the housing between the first end and the second end, the housing including at least one divider along at least a portion of the channel to partition the channel into at least two areas; and a plurality of retaining members coupled to the housing using the channel, each retaining member operable to exert a retaining force upon one or more adjacent retaining members, wherein the plurality of retaining members includes a hookless coupling segment conformal to the channel for coupling the retaining members to the housing.

Another aspect relates to an organizer for holding objects, including an elongated housing having a generally H-shape channel therein, an opening along a wall of the housing into the channel, resilient retaining members having legs, the legs of at least some adjacent retaining members provide a resilient force to urge the retaining members toward each other, and the legs of the retaining members having generally H-shape coupling segments coupled to the housing using the channel for retention of the retaining members to the housing.

Another aspect relates to a method of assembling an organizer that includes the steps of providing a housing including a first end, a second end, and a channel extending along at least a portion of the housing between the first end and the second end, the channel having at least one divider along at least a portion of the channel to separate the channel into at least two areas; and coupling a plurality of retaining members to the housing using the channel, the coupling including the steps of folding a retaining member of flexible material including a first end and a second end upon itself so as to place the first end and the second end in close proximity, the first end and the second end each including a hookless coupling segment conformal to the channel; inserting the first end and the second end into the channel; and rotating the retaining member to couple the first end and the second end of the retaining member in the channel.

To the accomplishment of the foregoing and related ends, the invention provides the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the detailed description that follows, identical components have been given the same reference numerals. To illustrate the present invention in a clear and concise manner, the drawings may not necessarily be to scale and certain features may be shown schematically.

DETAILED DESCRIPTION

Figure 1:
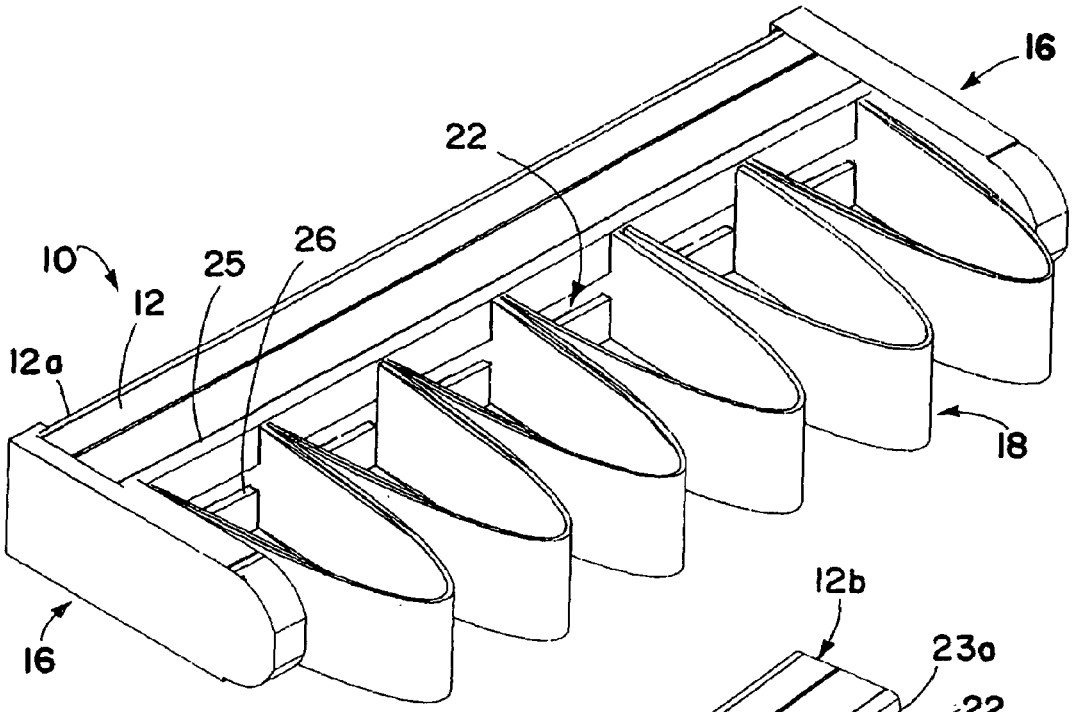
FIG. 1 is an isometric view of an organizer including a housing having a channel and channel end stops and resilient retaining members coupled to the housing.
Figure 2:
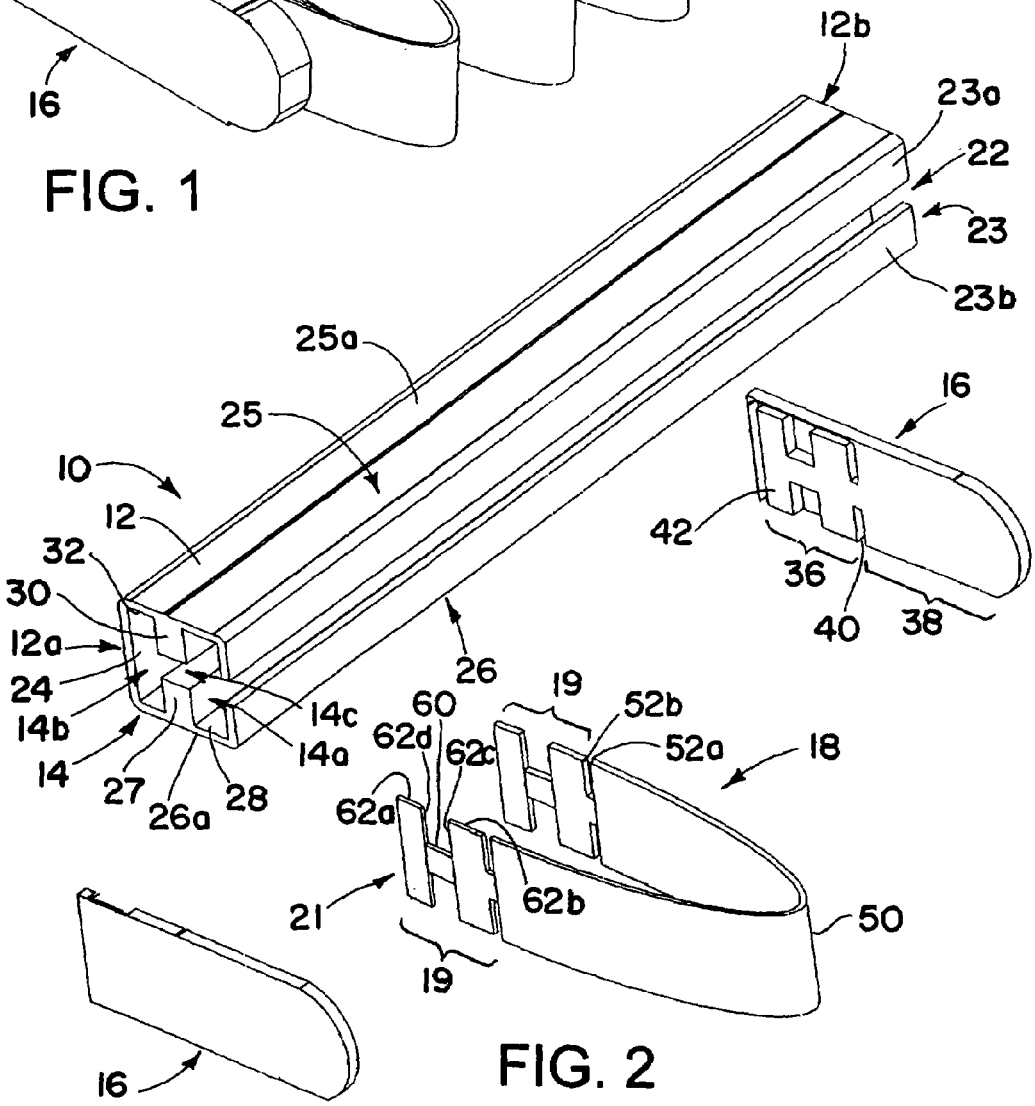
FIG. 2 is a partially exploded isometric view of the organizer shown in FIG. 1 illustrating the housing having the channel, end stops and one resilient retaining member.

With reference to FIGS. 1–2, the invention is an organizer 10 that includes a housing 12 having a channel 14, channel end stops 16 and a plurality of strip-like retaining members 18 that are bent to form loops coupled to the housing operable to secure an item placed between adjacent retaining members 18. The retaining members 18 are coupled to the housing 12 with a hookless coupling segment 19 that inhibits inadvertent removal, but allows the organizer to be reconfigured easily. For example, ends 21 of a retaining member 18 can be pressed toward each other, slipped through a slot 22 in the front wall 23 of the housing 12 into the channel 14 and then rotated to an orientation generally filling a cross sectional slice of the channel for retention of the retaining member ends therein. The bending force, on the retaining members then may be released, and the cooperation between the ends 21 and the housing walls at the channel 14 holds the retaining member to the housing. In this way retaining members 18 can be added to or removed from the housing.

One or more retaining members 18 also may be inserted from the end 12*a* or 12*b* of the housing without the channel end stop 16 in place at that end (12*a* or 12*b*) of the housing, e.g., before the channel end stop has been coupled to the housing 12. Further, the channel end stops are coupled to the housing using, e.g., using an alignment convenience provided by conformance with the wall at the end 12*a* or 12*b* of the housing and an open area of the channel.

Adjacent retaining members 18 are cooperable to provide a resilient force to secure an item placed between the adjacent retaining members. The channel end stops 16 maintain the resilient force between retaining members and prevent the retaining members 18 from sliding out of the channel 14.

Thus, an organizer 10 is described that uses resilient retaining members 18 and is easily reconfigurable. That is, the number of retaining members 18 coupled to the housing 12 of the organizer 10 easily can be increased or decreased. Further, the coupling of a retaining member 18 to a divided channel tends to inhibit inadvertent removal of the retaining member 18 when a force that is generally normal to the elongated extent of the housing 12 is applied to the retaining member 18.

Continuing to refer to FIGS. 1 and 2, the housing 12 has a first end 12*a* and a second end 12*b*. The housing 12 can be of any length, as may be desired. The organizer 10 may be relatively small to hold pens, pencils, screw drivers, wires, cables, and the like. If desired, the organizer 10 may be larger and stronger to hold, for example, heavy tools, such as electric tools, hammers, garden tools, etc. The length of retaining members 18 may be longer or shorter than they are shown in relation to the housing 12, and the length of the organizer can be virtually any length. The organizer 10 may be adequately large, strong and robust to attach to a vehicle, e.g., to a truck, to hold tools or other devices. The housing 12 also includes a back wall 24 (FIG. 2), a top flange 25 and a bottom flange 26. The top flange 25 and the bottom flange 26 project from the back wall 24 in a generally perpendicular and forward direction, relative to the back wall 24; the horizontal components of flanges 25, 26 in effect form top and bottom walls 25*a*, 26*a*, and the vertical components of flanges 25, 26 form respective upper and lower portions 23*a*, 23*b* of the front wall 23 between which the slot 22 is located. The back wall 24, the top flange 25, and the bottom flange 26 form the walls of the channel 14. Reference to direction, e.g., top and bottom, is for convenience of description but is not intended to be restrictive or limiting.

A divider 27 extends in a generally perpendicular and inward direction toward the central interior of the housing 12, relative to an inner surface 28 of the bottom flange 26. A divider 30 extends in a generally perpendicular and inward direction toward the central interior of the housing 12, relative to an inner surface 32 of the top flange 25. Looking at an end view of the housing 12, the divider 27 and the divider 30 extend into and define the channel 14 to appear to form the shape of the letter "H". The H-shape is a "void" area or substantially open space, and, therefore, the channel 14 is referred to as an H-shape channel. Either or both dividers 27 and 30 may be, for example, a rib, a wall, a ridge, a ramp, a partition, a track, a rail, a plica, a prism-shape divider or the like. The dividers 27 and/or 30 may be integral to or separate from housing 12. The housing 12 may include one or more dividers.

It will be appreciated that the H-shape channel may be other than an upper case letter "H" shape; it may be generally H-shape and, thus, have one or both legs and/or bridge portion non-linear, tapered, or some other shape while still providing a generally H-shape effect and functions as are described further below. The legs and bridge of the "H" form respective subchannels.

In an embodiment, the divider 27 and/or the divider 30 extend inward into and define the channel 14 to have respective subchannels 14*a*, 14*b*, which may be the same or different sizes. For example, as is illustrated, there is a wider subchannel 14*a* relative to a narrower subchannel 14*b*. The subchannels 14*a*, 14*b* are interconnected by an interconnecting subchannel 14*c*. The interconnecting subchannel 14*c* may be aligned or unaligned with the slot 22 formed by the top flange 25 and the bottom flange 26. The divider 27 and/or the divider 30 may project from the bottom flange 26 and/or the top flange 25 along the entire length of the housing 12, along only a portion of the length of the housing 12, or along a plurality of portions of the length of the housing 12.

The top flange 25 and the bottom flange 26 may project from the back wall 24 along the entire length of the housing 12, along only a portion of the length of the housing 12, or along a plurality of portions of the length of the housing 12. The top flange 25 and the bottom flange 26 may project from the back wall 24 at any angle, relative to the back wall 24, and may project from the back wall 24 at different angles, relative to one another. The present invention contemplates any configuration of the back wall 24, the top flange 25, at least one divider and the bottom flange 26 suitable to form channel 14 along at least a portion of the length of the housing 12. Additionally, the housing 12 may be curved, having a curved back wall 24, a curved top flange 25, at least one curved divider (27, 30) and a curved bottom flange 26.

Channel end stops 16 are coupled to the housing 12 using the top flange 25, bottom flange 26, and channel 14 to prevent the retaining members 18 from sliding out of the channel 14. Channel end stops 16 include a coupling segment 36 and a body segment 38. The coupling segment 36 is conformal to the channel 14. Coupling segment 36 and body segment 38 are partially separated by notches 40 operable to receive the top flange 25, the at least one divider (27, 30) and the bottom flange 26 when end stops 16 are coupled to the housing 12. That is, coupling segment 36 has a shape that generally corresponds to the shape of the channel 14. For example, when the channel 14 is H-shape, the coupling segment 36 will include, for example, a raised H-shape portion 42 conformal to the channel 14 and designed to fill or substantially to fill the channel 14 when the end stop 16 is fixedly secured to the housing 12. Coupling segment 36 may be integral to or separate from body segment 38. The end stops 16 may include a raised wall or ramp to engage the retaining member 18 adjacent thereto.

Figure 3:
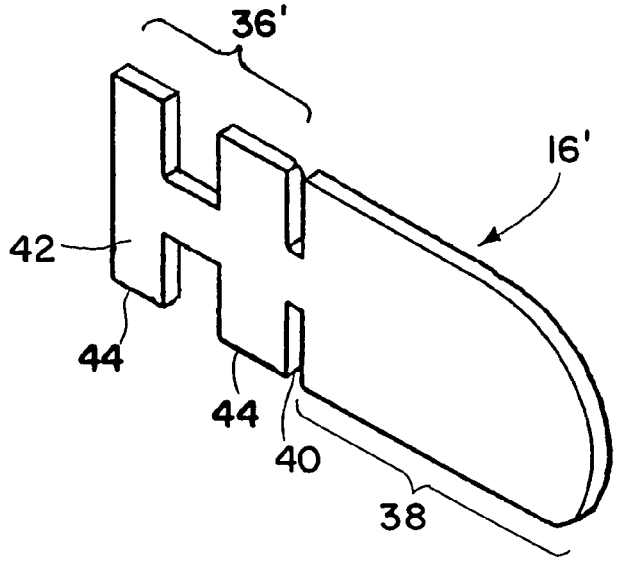
FIG. 3 is an isometric view of a stop member.
Figure 4:
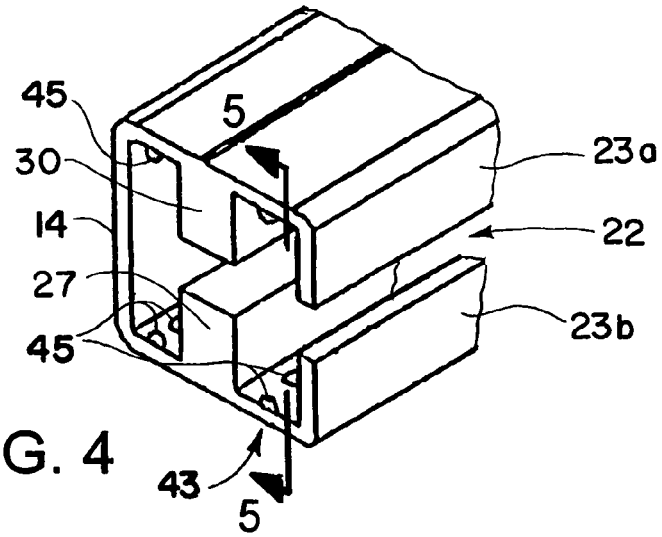
FIG. 4 is a fragmentary isometric view of a housing with detents.
Figure 5:
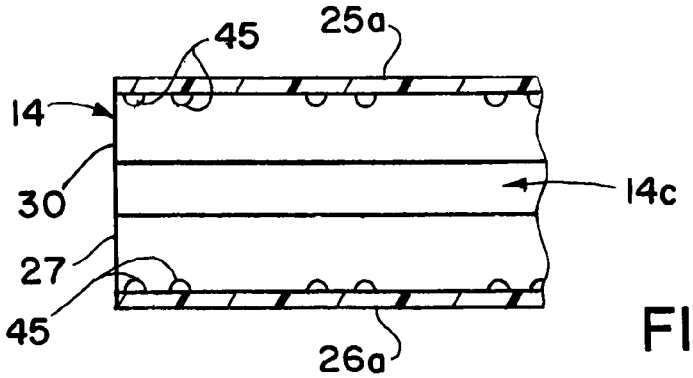
FIG. 5 is a fragmentary section view of the housing looking in the direction of arrows 5—5 of FIG. 4.

Referring also to FIGS. 3–5, in an embodiment, one or both channel end stops 16 or a separate end stop-like member, e.g., the stop 16' illustrated schematically in FIG. 3. are operable to slide along at least a portion of the length of the channel 14. For example, the coupling segment 36' of the stop 16' may have the same shape as the coupling segment of the retaining member 18 described below. A locking mechanism 43 may further be provided to retain the stop 16' at a desired location along the length of the housing 12. For example, the end portions 44 of the coupling segment 36' may be resilient or may be spring-loaded and/or outwardly biased into slots or detents 45 in the surfaces 28 and 32 provided at particular intervals along the channel 14, as is illustrated schematically in FIGS. 4 and 5. The spring-loaded portions would travel along the channel 14 until reaching respective detents 45, where the end portions 44 would extend into the void between the detents to lock the coupling segment 36' in place. Alternatively, a bump (not shown) may be formed in the channel 14 over which the spring-loaded end portions would readily pass over in a first direction, but which would inhibit or prevent the spring-loaded end portions from passing in a second direction opposite the first direction. If desired, the retaining members 18 may be held in longitudinal position in the channel 14 by a friction fit.

Channel end stops 16 may be fixedly secured to the housing 12 near the ends of the housing 12 using ultra-sonic welding, adhesive or other means for example. Alternatively or additionally, screws (not shown) may be used to secure the channel end stop 16 to the housing 12. For example, a screw may be inserted into a recessed hole in coupling segment 36 corresponding to the divider (27, 30) in the housing 12, and is operable to bring coupling segment 36 tightly into contact with the top flange 25, the at least one divider (27, 30) and the bottom flange 26 to secure the channel end stop 16 to the housing 12. The present invention contemplates other fastening agents to fixedly secure channel end stops 16 to the housing 12. The present invention further contemplates channel end stops 16 that are integral to the housing 12.

As shown in FIG. 1, a plurality of retaining members 18 are coupled to the housing 12 using the top flange 25, bottom flange 26 and channel 14. The present invention contemplates retaining members 18 suitable to secure tools, cables, pens, pencils or other objects in a similar manner to that described herein.

Retaining members 18 are coupled to the housing 12 between channel end stops 16 using the top flange 25, bottom flange 26, and channel 14. Each retaining member 18 is operable to exert a generally lateral retaining force upon one or more adjacent retaining members 18 along the general direction of channel 14. With channel end stops 16 are fixedly secured to the housing 12, the organizer 10 is operable to maintain the generally lateral retaining forces exerted between adjacent retaining members 18 and prevent retaining members 18 from escaping laterally from channel 14.

When an item (not shown), for example, a tool, a cable, or other object, is inserted between adjacent retaining members 18, the organizer 10 is operable to hold the item, relatively securely so it tends not to fall away, using the generally lateral retaining forces exerted by adjacent retaining members 18 on the item. In an embodiment, the item is inserted between adjacent retaining members 18 from a generally forward position, relative to the back wall 24. Due to the construction of the retaining members 18, the insertion of the item between the adjacent retaining members 18 causes the adjacent retaining members 18 to move laterally apart from one another in an amount sufficient to allow the item to rest between and be secured by the adjacent retaining members 18. In an embodiment, as additional items are inserted between and secured by the various retaining members 18, the retaining force exerted by each retaining member 18 on one or more adjacent retaining members 18 may increase accordingly.

The item may be removed from between adjacent retaining members 18 by exerting a removal force on the item sufficient to release the item from between the adjacent retaining members 18. The removal force exerted on the item may be in a forward, upward, or downward direction, relative to the housing 12, or in any combination of the forward, upward, and downward directions suitable to remove the item from between the adjacent retaining members 18. The removal force exerted on the item may additionally have a lateral component, relative to the housing 12. As the items are removed from between the various retaining members 18, the retaining force exerted by each of the retaining members 18 on the one or more adjacent retaining members 18 is decreased accordingly.

Figure 8:
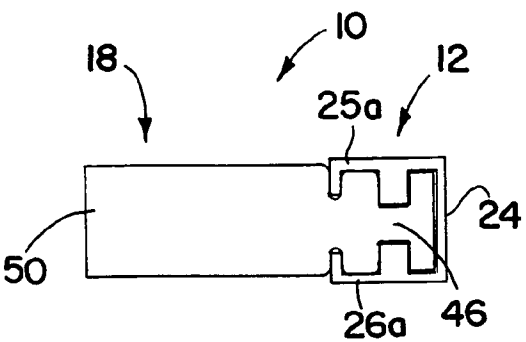
FIG. 8 is a side view of the organizer shown in FIG. 1 with an end stop removed showing one resilient retaining member coupled to the housing.
Figure 7:
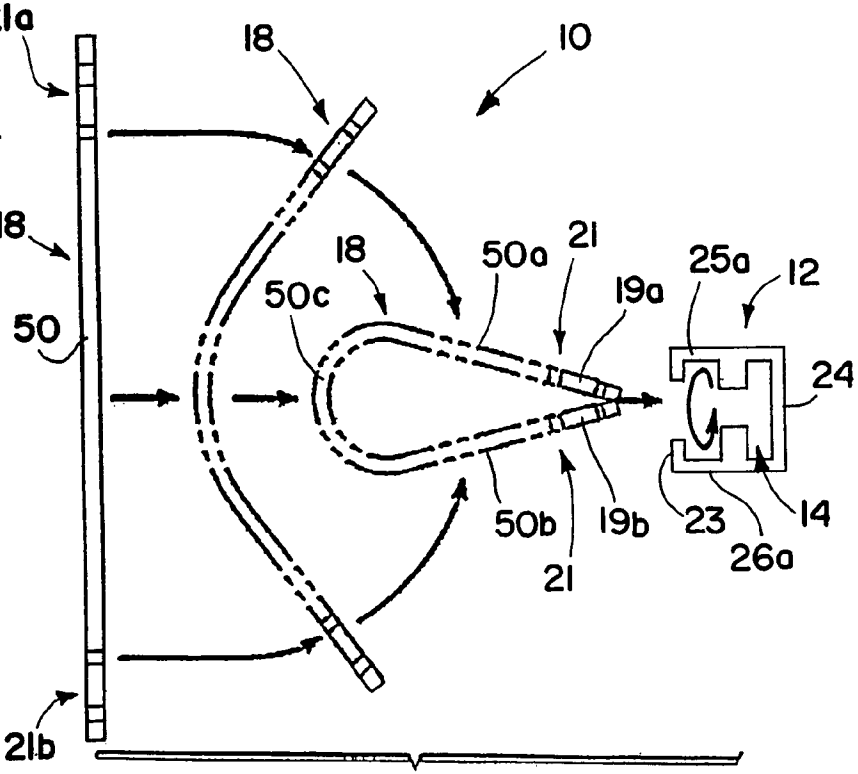
FIG. 7 illustrates a method of forming a retaining member and coupling the retaining member to the housing.
Figure 6:
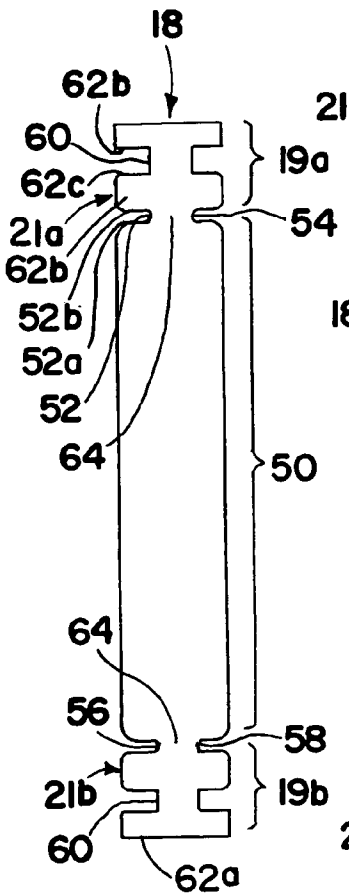
FIG. 6 is a plan view of a flattened resilient retaining member.

FIGS. 6–8 illustrate forming the retaining member 18 and the method for coupling the retaining member 18 to the housing 12. The retaining member 18 includes a first end 21*a* and a second end 21*b*. Coupling segments 19*a* and 19*b*, conformal to the channel 14, are located at or near the first and second ends 21*a* and 21*b*, respectively, and a body portion 50 is located generally between coupling segments 19*a* and 19*b*. Coupling segments 19*a* and 19*b* are partially separated from the body portion 50 by notches 52 and 54, and notches 56 and 58, respectively.

In use, the retaining members 18 are bent or folded over to form a loop having respective legs 50*a*, 50*b*, on each side of a curved portion on 50*c*. The material, e.g., plastic, polymer, metal, etc., of which retaining members 18 are made may be sufficiently flexible so that when folded to provide the curved or looped portion 50*c*, the curved portion tends to provide a resilient force urging the legs apart. At the first end 21*a* and the second end 21*b* of each leg 50*a* and 50*b*, a portion of the material is cut away to leave H-shape coupling segments 19*a* and 19*b*, respectively. Each H-shape coupling segment 19*a* and 19*b* has a center support 60 and a pair of legs 62*a* and 62*b* that extend generally perpendicularly from the center support to form the H-shape coupling segment that is coupled by an extension 64 of the center support to the major extent of the respective leg. The H-shape coupling segment is conformed to the H-shape channel 14 in the housing 12 so that the H-shape coupling segments 19*a* and 19*b* can fit in and slide along the H-shape channel 14 in the housing 12 while the extension 64, i.e., the forward-most part of the support of the H-shape coupling segments 19*a* and 19*b*, passes through and slides in the open slot 22 in the front wall of the housing 12. In an embodiment, the pair of legs 62*a* and 62*b* are asymmetrical, for example, the leg 62*a* is narrower than the leg 62*b*.

As was mentioned above, the subchannels 14*a*, 14*b* may be the same or different sizes. Having two subchannels tends to enhance secure retention of the retaining members 18 to the housing 12. Having the respective notches 60 closer to the notches 52–58 in the coupling segments 19*a*, 19*b* of the retaining members 18 may increase stability of the retention of the retaining members by the housing and the stability of the organizer 10 as a whole. Further, the use of a relatively narrow thickness front wall 23 and correspondingly relatively narrow notches 52–58 into which part of the front wall fits may add to stability of the organizer 10 relative to a thicker front wall and notches 52–58.

Coupling segments 19*a* and 19*b* may be integral to or separate from body portion 50. The present invention contemplates forming retaining member 18 from a sheet of any shape and any material suitable to allow retaining member 18 to cooperate with an adjacent retaining members 18 to secure an item between the retaining member 18 and the adjacent retaining member 18. The retaining members 18 may be made of, for example, a low density polyethylene plastic or other appropriate material. The retaining members 18 may be cut from a plastic sheet using a conventional die cutting technique or some other technique.

The corners of the coupling segments 19*a*, 19*b* and/or other corner portions of the retaining members may be relatively sharp or square as is illustrated or may have a radius, e.g., be somewhat curved or polygonal. Such curvature facilitates insertion and renewal of retaining members with respect to the channel 14 and avoids bending of the material at the mentioned corners of the coupling segments.

As shown in FIG. 7, first and second ends 21*a* and 21*b*, respectively, may be placed in close proximity to each other by folding retaining member 18 upon itself about the midline between coupling segments 19*a* and 19*b*. When the first and second ends 21*a* and 21*b*, respectively, are in close enough proximity, e.g., so they will fit through the slot 22 of the housing 12, the coupling segments 19*a* and 19*b* may be inserted through the slot 22 into channel 14 of the housing 12 and the retaining member 18 turned approximately ninety degrees. When the first and second ends 21*a* and 21*b*, respectively, are released, the first and second ends 21*a* and 21*b*, respectively, may expand laterally apart from one another along the direction of channel 14 until the first and second ends 21*a* and 21*b*, respectively, contact adjacent retaining members 18. The coupling segments 19*a* and 19*b* of each retaining member 18 coupled to the housing 12 in the manner described above are positioned within the channel 14 as shown in FIG. 8.

When a retaining member 18 and a plurality of other retaining members 18 are coupled to the housing 12 between channel end stops 16, the retaining member 18 is operable to exert generally lateral retaining forces upon adjacent retaining members 18 due to the construction and resulting elastic behavior of the retaining member 18. The behavior of the retaining member 18 may resemble that of a spring positioned between the adjacent retaining members 18. When a plurality of retaining members 18 are coupled to the housing 12, each retaining member 18 is operable to behave in the manner described above to exert a generally lateral retaining force upon adjacent retaining members 18. In the embodiment shown in FIG. 8, the retaining member 18 includes coupling segments 19*a* and 19*b* that may be slidingly inserted into channel 14 from either end of the channel 14 before one or both end stops 16 are fixedly coupled to the housing 12. Due to the cooperating shapes of the coupling segments 19*a* and 19*b*, the channel 14, the top flange 25 and the bottom flange 26, the retaining member 18 may be slid along at least a portion of the length of channel 14 until the retaining member 18 reaches a desired position.

The housing 12 is constructed from a relatively rigid material, for example, metal, high density plastic, or any other material suitable to allow the coupling segments 19*a* and 19*b* to slide within the channel 14 and maintain its shape while supporting an item. The housing 12 may be formed by extrusion, molding, or some other technique. The end stops 16 may be of plastic, metal, or some other material. The end stops 16 may be made by molding or some other technique. If desired, the housing 12 and the end stops 16 attached thereto can be molded as a single unit, e.g., using plastic insert molding techniques or some other technique. The housing and/or other parts of the organizer 10 may be made of metal, e.g., stainless steel, or of other material.

The back wall 24 may include an adhesive strip (not shown) for supporting the organizer 10 or securing the organizer 10 to a desired surface either vertically or horizontally. The back wall 24 may include one or more slots, holes, etc. (not shown) operable to receive one or more supporting agents, for example, a screw, a nail, a peg or the like, for supporting the organizer 10 or securing the organizer 10 to a desired surface.

Although several channel 14 shapes and several conformal coupling segments 19*a* and 19*b* shapes have been described above, the present invention contemplates other compatible shapes. For example, if only one divider, for example, the divider 27, is formed in the channel 14, then when looking at an end view of the housing 12, the channel 14 appears to form the shape of the letter "n". If only one divider, for example, the divider 30, is formed in the channel 14, then when looking at an end view of the housing 12, the channel 14 appears to form the shape of the letter "U". If the dividers used are ramp-shape, then when looking at an end view of the housing 12, the channel 14 appears to form the shape of the letter "K" or the mirror image of the letter "K". If the dividers used are prism shape and a third prism shape divider is formed on the back wall 24, then when looking at an end view of the housing 12, the channel 14 appears to form the shape of the letter "X". When these alternative channel shapes are used then conformal coupling segments are formed at the ends 21*a* and 21*b* of the retaining members 18 secure the retaining members 18 to the housing 12 as explained above. The present invention contemplates as many other combinations of channel 14 shapes and the conformal coupling segments 19*a* and 19*b* shapes as are suitable to allow the organizer 10 to secure one or more retaining members 18.

The invention thus provides a simple and reliable mechanism to reconfigure the organizer, e.g., both to retain the retaining members 18 in the housing 12 and to remove or add one or more of the retaining members 18, as desired. Further, the coupling segments 19*a* and 19*b* conform to the shape of the channel 14 eliminating the need for a hooked coupling segment to retain the coupling segment in the housing 12, thereby minimizing or eliminating the risk of damage to the retaining member.

Figure 9:
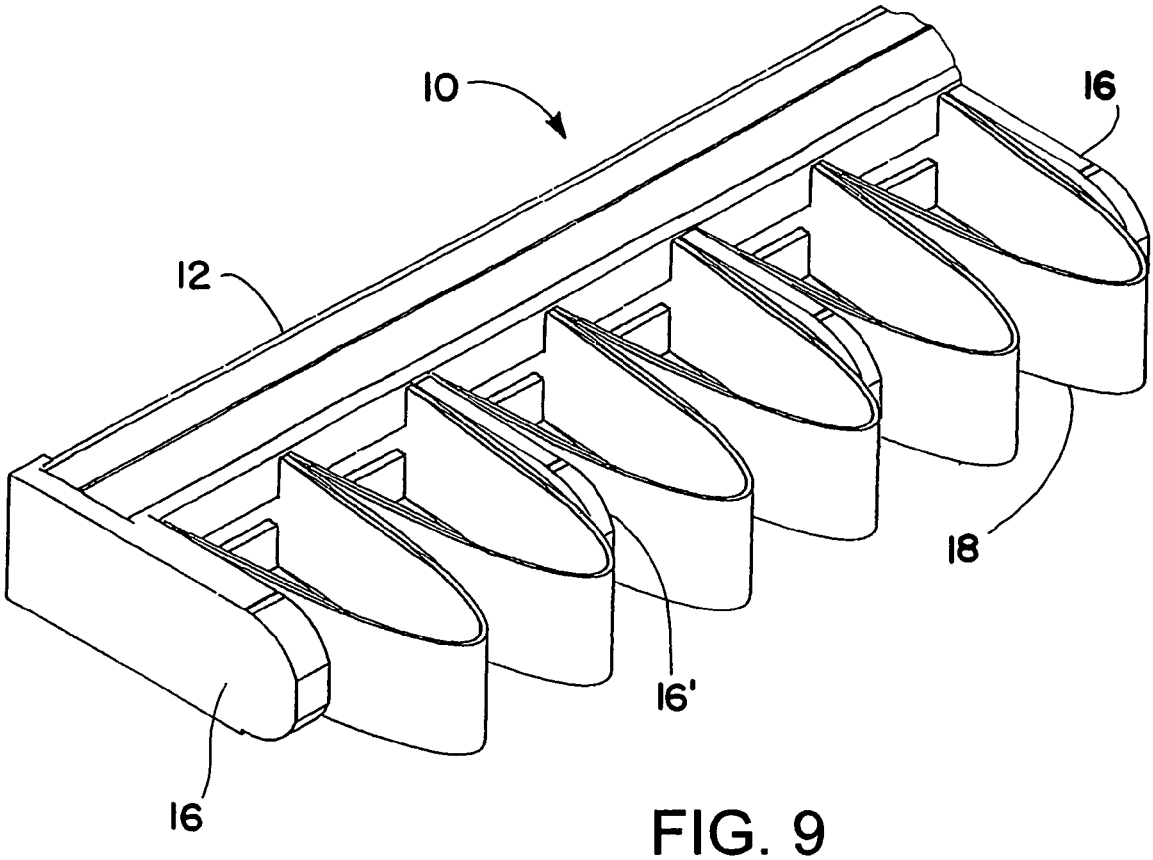
FIG. 9 is a schematic isometric view of an organizer with the stop member of FIG. 3 along the length of the housing.

If desired, a stop 16' may be moved to a desired longitudinal position in the channel 14 to vary the effective length of the housing 12, used for holding retaining members. Also, if desired one or more stops 16' may be positioned at desired locations along the channel to help distribute force among respective retaining members that are between respective pairs of stops and channel end stops, e.g., as shown in FIG. 9.

Although the invention has been shown and described with respect to certain preferred embodiments, it is obvious that equivalent alterations and modifications will occur to others skilled in the art upon the reading and understanding of this specification and the annexed drawings. In particular regard to the various functions performed by the above described components (assemblies, devices, etc.), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more other features of the other embodiments as may be desired and advantageous for any given or particular application.

What is claimed is:

1. An organizer, comprising:

a housing having a first end, a second end, and a channel extending along at least a portion of the housing between the first end and the second end, the housing including at least one divider along at least a portion of the channel to partition the channel into at least two areas; and a plurality of retaining members coupled to the housing using the channel, each retaining member comprising a pair of leas flexibly connected to each other at a curved portion that resiliently urges the legs apart to exert a retaining force upon one or more adjacent retaining members, wherein the plurality of retaining members includes a hookless coupling segment conformal to the channel for coupling the retaining members to the housing, the legs of a retaining member being movable resiliently to close proximity to each other for insertion of the hookless coupling segment into the channel and for rotation therein to place the hookless coupling segment in retaining relation to the channel.

2. An organizer as set forth in claim 1, wherein the divider partitions the channel into a first area relatively wider than a second area.

3. An organizer as set forth in claim 1, further comprising end stops including a coupling segment conformal to the channel for coupling the end stops to the housing.

4. An organizer as set forth in claim 3, wherein the end stops are fixedly secured to the housing.

5. An organizer as set forth in claim 3, wherein the end stops are movable.

6. An organizer as set forth in claim 1, wherein the retaining members are removably coupled to the housing using the coupling segments.

7. An organizer as set forth in claim 6, wherein the coupling segments are operable to slide within the channel along at least a portion of the channel.

8. An organizer as set forth in claim 1, wherein a retaining member is operable to cooperate with an adjacent retaining member to secure an item placed between the retaining member and the adjacent retaining member.

9. An organizer as set forth in claim 1, wherein the retaining member is a retaining member of flexible material including a first end and a second end.

10. An organizer as set forth in claim 9, wherein the first end and the second end each including a hookless coupling segment conformal to the channel.

11. An organizer as set forth in claim 1, further comprising at least one movable stop positionable along the length of the housing.

12. An organizer as set forth in claim 11, further comprising means for holding the stop at a respective position along the length of the housing.

13. An organizer as set forth in claim 1, wherein corners of retaining members are curved.

14. The organizer as set forth in claim 1, wherein the legs of a retaining member connected in the channel are movable resiliently to close proximity to each other for rotation of the hookless coupling segment in the channel out of retaining relation to the channel to permit withdrawal of the hookless coupling segment from the channel.

15. An organizer as set forth in claim 1, wherein the coupling segments are H-shape.

16. An organizer as set forth in claim 15, wherein the channel has an H-shape generally open area to receive the H-shape coupling segments in retained relation therein.

17. An organizer, comprising:

a housing having a first end, a second end, and a channel extending along at least a portion of the housing between the first end and the second end, the housing including at least one divider along at least a portion of the channel to partition the channel into at least two areas; and a plurality of retaining members coupled to the housing using the channel, each retaining member operable to exert a retaining force upon one or more adjacent retaining members, wherein the plurality of retaining members includes a hookless coupling segment conformal to the channel for coupling the retaining members to the housing, and wherein the coupling segments are H-shape.

18. An organizer as set forth in claim 17, wherein the divider partitions the channel into a first area relatively wider than a second area.

19. An organizer as set forth in claim 17, further comprising end stops including a coupling segment conformal to the channel for coupling the end stops to the housing.

20. An organizer as set forth in claim 19, wherein the end stops are movable.

21. An organizer as set forth in claim 17, wherein a retaining member is operable to cooperate with an adjacent retaining member to secure an item placed between the retaining member and the adjacent retaining member.

22. An organizer as set forth in claim 17, wherein the channel has an H-shape generally open area to receive the H-shape coupling segments in retained relation therein.

23. An organizer as set forth in claim 17, further comprising at least one movable stop positionable along the length of the housing.

24. An organizer as set forth in claim 23, further comprising means for holding the stop at a respective position along the length of the housing.

25. An organizer as set forth in claim 17, wherein corners of retaining members are curved.

26. An organizer for holding objects, comprising:

an elongated housing having generally H-shape channel therein, an opening along a wall of the housing into the channel, resilient retaining members having legs, the legs of at least some adjacent retaining members provide a resilient force to urge the retaining members toward each other, and the legs of the retaining members having generally H-shape coupling segments coupled to the housing using the channel for retention of the retaining members to the housing.

27. An organizer as set forth in claim 26, wherein the retaining members are removably coupled to the housing using the coupling segments.

28. An organizer as set forth in claim 26, wherein each leg includes a coupling segment having a first portion relatively wider than a second portion.

29. An organizer as set forth in claim 26, wherein an end stop closes an end of the housing.

30. An organizer as set forth in claim 29, wherein the end stop maintains the resilient force between the retaining members.

31. An organizer as set forth in claim 26, further comprising at least one movable stop positionable along the length of the housing.

32. An organizer as set forth in claim 31, further comprising means for holding the stop at a respective position along the length of the housing.

33. An organizer as set forth in claim 26, wherein corners of retaining members are curved.

34. A method of assembling an organizer that includes a housing including a first end, a second end, and a channel extending along at least a portion of the housing between the first end and the second end, the channel having at least one divider along at least a portion of the channel to separate the channel into at least two areas; and a plurality of retaining members having a pair of legs flexibly connected to each other at a curved portion that resiliently urges the legs apart to exert a retaining force upon one or more adjacent retaining members and a hookless coupling segment at the end of each leg conformal to the channel for coupling the retaining members to the housing, the method comprising coupling a plurality of retaining members to the housing using the channel, the coupling including the steps of:

folding a retaining member about the curved portion so as to place the ends of the pair of legs in close proximity;

inserting the ends of the pair of legs into the channel; and rotating the retaining member to couple the hookless coupling segments in the channel thereby to hold the retaining member in the channel.

35. A method as set forth in claim 34, further including the step of:

coupling an end stop to the housing at the channel.

36. An organizer, comprising:

a housing having a first end, a second end, and a channel extending along at least a portion of the housing between the first end and the second end, the housing including at least one divider along at least a portion of the channel to partition the channel into at least two areas; and a plurality of retaining members coupled to the housing using the channel, each retaining member operable to exert a retaining force upon one or more adjacent retaining members, wherein the plurality of retaining members includes a hookless coupling segment conformal to the channel for coupling the retaining members to the housing, the hookless coupling segment being removable from and reinsertable into the channel at the front of the channel for, respectively, removal from and reattachment to the housing.

* * * * *

UNITED STATES PATENT AND TRADEMARK OFFICE

CERTIFICATE OF CORRECTION

PATENT NO. : 7,028,854 B1
APPLICATION NO. : 10/692776
DATED : April 18, 2006
INVENTOR(S) : Philip Londrico It is certified that error appears in the above-identified patent and that said Letters Patent is hereby corrected as shown below:

Claim 1, Line 10, replace "pair of leas flexibly" with --pair of legs flexibly--.

Signed and Sealed this

Eighth Day of August, 2006

JON W. DUDAS
*Director of the United States Patent and Trademark Office*